US006924422B2

(12) United States Patent
Wise

(10) Patent No.: US 6,924,422 B2
(45) Date of Patent: Aug. 2, 2005

(54) DRUM PEDAL STABILIZER

(76) Inventor: Jonathan Wise, 34700 Royalton Rd., Grafton, OH (US) 44044

( * ) Notice: Subject to any disclaimer, the term of this patent is extended or adjusted under 35 U.S.C. 154(b) by 0 days.

(21) Appl. No.: 10/846,545

(22) Filed: May 17, 2004

(65) Prior Publication Data

US 2005/0016358 A1 Jan. 27, 2005

Related U.S. Application Data

(60) Provisional application No. 60/489,110, filed on Jul. 23, 2003.

(51) Int. Cl.[7] ..... G10D 13/02

(52) U.S. Cl. ..... 84/422.1; 84/422.2; 84/422.3

(58) Field of Search ..... 84/422.1, 422.2, 84/422.3

(56) References Cited

U.S. PATENT DOCUMENTS

| | | | | |
|---|---|---|---|---|
| 886,471 A | | 5/1908 | Britton | 84/422.1 |
| 2,736,823 A | | 2/1956 | Sheppard et al. | 310/327 |
| 3,381,565 A | | 5/1968 | Haile | 84/444 |
| 3,426,640 A | | 2/1969 | Slingerland, Jr. | 84/422.1 |
| 3,618,441 A | | 11/1971 | Fearns | 84/422.1 |
| 3,797,356 A | | 3/1974 | Duffy et al. | 84/422.1 |
| 3,903,777 A | * | 9/1975 | Corbett | 84/341 |
| 4,048,896 A | | 9/1977 | Calato et al. | 526/129 |
| 4,121,490 A | | 10/1978 | Deutsch | 84/626 |
| 4,152,967 A | | 5/1979 | Barron | 84/236 |
| 4,262,576 A | | 4/1981 | Gorsky et al. | 84/422.1 |
| 4,356,471 A | | 10/1982 | Nienaber | 340/439 |
| 4,410,825 A | | 10/1983 | Lobastov | 310/327 |
| 4,756,224 A | | 7/1988 | Lombardi | 84/422.1 |
| 4,760,768 A | * | 8/1988 | Yamamoto | 84/236 |
| 4,890,532 A | | 1/1990 | Carlson | 84/422.1 |
| 4,945,802 A | | 8/1990 | Ruprecht | 84/422.1 |
| 5,026,248 A | | 6/1991 | Hamilton | 414/729 |
| 5,362,046 A | | 11/1994 | Sims | 473/300 |
| 5,365,824 A | | 11/1994 | Hoshino | 84/422.1 |
| 5,704,259 A | | 1/1998 | Riehle | 81/22 |
| 5,798,472 A | | 8/1998 | Shigenaga | 84/422.1 |
| 5,911,795 A | | 6/1999 | Tucker | 81/22 |
| 6,096,955 A | * | 8/2000 | Ter Heide | 84/421 |
| 6,239,342 B1 | | 5/2001 | Chang | 84/422.1 |

FOREIGN PATENT DOCUMENTS

| | | |
|---|---|---|
| DE | 2 061 077 | 6/1972 |
| JP | 03233599 | * 10/1991 |

* cited by examiner

*Primary Examiner*—Shih-Yung Hsieh
(74) *Attorney, Agent, or Firm*—Richard C. Litman

(57) ABSTRACT

The drum pedal stabilizer is designed to eliminate the problems of beater dropout, pedal and beater oscillation, drum head retrigger, tempo influence and jitter feel on drum pedals and beaters. Specifically, the present invention is directed to a stabilizer having a mounting plate and a gas spring adapted for attachment to a drum pedal to counteract oscillation of the conventional helical spring. The stabilizer may be an aftermarket attachment to conventional drum pedals, or may be incorporated as original equipment in new drum pedal assemblies.

11 Claims, 5 Drawing Sheets

DRUM PEDAL STABILIZER

CROSS-REFERENCE TO RELATED APPLICATION

This application claims the benefit of U.S. Provisional Patent Application Ser. No. 60/489,110, filed Jul. 23, 2003.

BACKGROUND OF THE INVENTION

1. Field of the Invention

The present invention relates to musical instruments, and more particularly to a drum pedal stabilizer which prevents spring oscillation and eliminates a phenomenon known as hammerdown in a drum pedal used with a bass drum or other kick drum in a drum set.

2. Description of the Related Art

Performers, including professional and amateur drummers and musicians, use a drum pedal to play a kick drum, bass drum, and the like, commonly included as part of a drum kit. These performers seek absolute control of the speed and feel of the drum pedal in order to achieve the ability to perform what is required. This is particularly true for drummers who play music requiring a modulating or any tempo.

When a drum pedal is required to perform dynamic and speedy or fast tempo responses in accordance with the velocity and tempo applied by the performer's foot, by way of pedal depression, the drum pedal must be stabilized or it cannot function in a manner that is comfortable, non-influential and dependable. This is due to the oscillatory nature of conventional steel springs on known pedals used to return the foot pedal and beater to the neutral position, as well as inertia of the beater. The weight of the beater exaggerates the amount of oscillation. This undesirable oscillation causes problems known as beater dropout, pedal and beater oscillation, drum head retrigger, tempo influence and jitter feel. In other words, the undesirable oscillation may cause an unintentional drum strike.

Unwanted oscillation of the pedal spring may cause rhythm flutter, resulting in irregular back pressure on the foot pedal and consequent variation in the arc described by the beater, so that the rhythm of the bass drum may be thrown off tempo. If the spring return and inertia of the beater are strong enough, the beater hammer may return to a position either in contact with, or closely adjacent to, the drum head after release of the foot pedal, so that when the foot pedal is next pressed, the result is either no sound or a softer sound than desired, a phenomenon referred to as hammerdown or dropout. Even minor spring oscillation causes rhythmic fluctuations that are predetermined by the tension of the return spring, so that when these fluctuations match music tempos, the phenomenon of hammerdown occurs.

Spring return is a fast, reliable method of returning the beater in a drum pedal and beater. However, conventional countering spring methods only transfer oscillation back and forth and do not stop oscillation, or thoroughly reduce or stabilize the drum pedal and beater. Total pneumatic systems are too slow for speedy performance. Also, pneumatic type drum beaters are expensive.

A variety of devices have been proposed for controlling a drum pedal and beater. However, the devices of the prior art have not solved the above-referenced problems.

U.S. Pat. No. 886,471, issued May 5, 1908 to Britton, describes a pneumatically operated drumbeater that suppresses oscillatory motion of the beater. U.S. Pat. No. 2,736,823, issued Feb. 28, 1956 to Sheppard et al., describes an acoustic transducer and damping assembly. U.S. Pat. No. 3,381,565, issued May 7, 1968 to Haile, describes a foot-operated chord organ.

U.S. Pat. No. 3,426,640, issued Feb. 11, 1969 to Slingerland, Jr., describes a quick connect pedal connector. U.S. Pat. No. 3,618,441, issued Nov. 9, 1971 to Fearns, describes a double acting drum pedal. U.S. Pat. No. 3,797,356, issued Mar. 19, 1974 to Duffy et al., describes a linkage for a foot operated bass drum pedal.

U.S. Pat. No. 4,048,896, issued Sep. 20, 1977 to Calato et al., describes a drum pedal with an opposing and adjustable set of springs for dampening the oscillatory motion of the drumbeater. U.S. Pat. No. 4,121,490, issued Oct. 24, 1978 to Deutsch, describes a touch responsive electronic piano. U.S. Pat. No. 4,152,967, issued May 8, 1979 to Barron, describes pneumatic piano action.

U.S. Pat. No. 4,262,576, issued Apr. 21, 1981 to Gorsky et al., describes a percussion instrument striking apparatus. U.S. Pat. No. 4,356,471, issued Oct. 26, 1982 to Nienaber, describes a gas pedal movement damper. U.S. Pat. No. 4,410,825, issued Oct. 18, 1983 to Lobastov, describes a piezoelectric pressure transducer with a threaded damper bar.

U.S. Pat. No. 4,756,224, issued Jul. 12, 1988 to Lombardi, describes a drum beating apparatus with an eccentric rotor. U.S. Pat. No. 4,890,532, issued Jan. 2, 1990 to Carlson, describes a foot activated musical drum pedal device. U.S. Pat. No. 4,945,802, issued Aug. 7, 1990 to Ruprecht, describes a viscous damper incorporated into the linkage of a foot actuated drum pedal for stabilizing a beater's return oscillatory motion.

U.S. Pat. No. 5,026,248, issued Jun. 25, 1991 to Hamilton, describes a hydrodynamic swing damper and tree handling vehicle incorporating the same. U.S. Pat. No. 5,362,046, issued Nov. 8, 1994 to Sims, describes vibration damping. U.S. Pat. No. 5,365,824, issued Nov. 22, 1994 to Hoshino, describes a spring adjustment mechanism for a drum pedal beater.

U.S. Pat. No. 5,704,259, issued Jan. 6, 1998 to Riehle, describes a hand operated impact implement having a tuned vibration absorber. U.S. Pat. No. 5,798,472, issued Aug. 25, 1998 to Shigenaga, describes a drum beater for a bass drum equipped with an exactly adjustable return spring regulator. U.S. Pat. No. 5,911,795, issued Jun. 15, 1999 to Tucker, describes a hammer with a vibration damper and a method of making the same.

U.S. Pat. No. 6,239,342, issued May 29, 2001 to Chang, describes a stretching structure of a drum foot pedal. German Patent No. 2,061,077, published Jun. 15, 1972, describes a foot pedal mechanism for a beater.

None of the above inventions and patents, taken either singly or in combination, is seen to describe the instant invention as claimed. Thus a drum pedal stabilizer solving the aforementioned problems is desired.

SUMMARY OF THE INVENTION

The present invention is a drum pedal stabilizer designed to eliminate the problems of beater dropout, pedal and beater oscillation, drum head retrigger, tempo influence and jitter feel on drum pedals and beaters. Specifically, the present invention is directed to a stabilizer having a mounting plate and a gas spring adapted for attachment to a drum pedal to counteract oscillation of the conventional helical spring. The stabilizer may be an aftermarket attachment to conventional drum pedals, or may be incorporated as original equipment in new drum pedal assemblies.

The stabilizer offsets the helical return spring's position from the gas spring's position in order to maximize the stabilizer effect. The forward pressure of the gas spring not only counters the return spring, but adds forward push that makes high return spring pressure less resistant to depression while maintaining a weighted feel. The weighted feel is necessary for dynamic velocity control. Furthermore, tempo is no longer influenced or interrupted when the stabilizer is used.

The stabilizer may be used in conjunction with an adjustable linkage for adjusting pedal height. The adjustable linkage may be provided by a turnbuckle placed between the toe of the foot plate and the beater shaft. Alternatively, the adjustable linkage may be provided by telescoping rods having apertures which may be aligned and fixed by inserting a pin through the aligned apertures at the desired pedal height.

Accordingly, it is a principal aspect of the invention to provide a drum pedal stabilizer that reduces or eliminates beater dropout, pedal and beater oscillation, drum head retrigger, tempo influence and jitter feel in a drum pedal. It is an additional aspect of the invention to provide a drum pedal stabilizer that stabilizes the entire drum pedal.

It is another aspect of the invention to provide a drum pedal stabilizer and dropout eliminator having a mounting plate and a gas spring.

It is a further aspect of the invention to provide a drum pedal having a stabilizer incorporated therein for eliminating hammerdown and rhythmic flutter.

Still another object of the invention is to provide a drum pedal stabilizer which provides a gas spring to oppose oscillation of a conventional helical drum pedal spring, thereby producing a weighted feel so that tempo is no longer influenced or interrupted.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
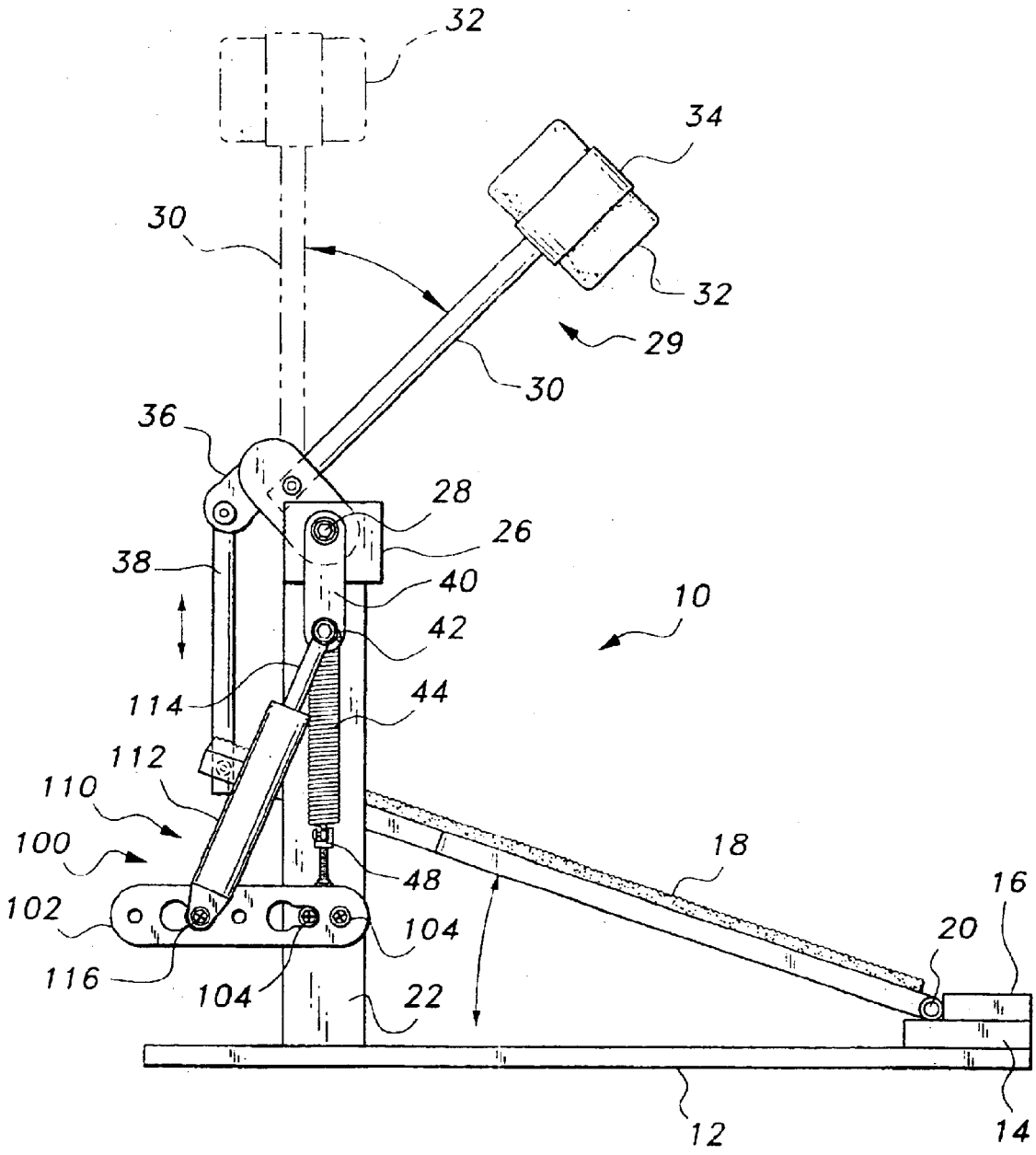
FIG. 1 is an environmental side view of a drum pedal stabilizer according to the present invention.

The present invention is directed to a drum pedal stabilizer, designated generally as 100 in the drawings. The stabilizer 100 reduces oscillation of the drum pedal return spring, thereby reducing rhythmic flutter and eliminating hammerdown or beater dropout.

Figure 2:
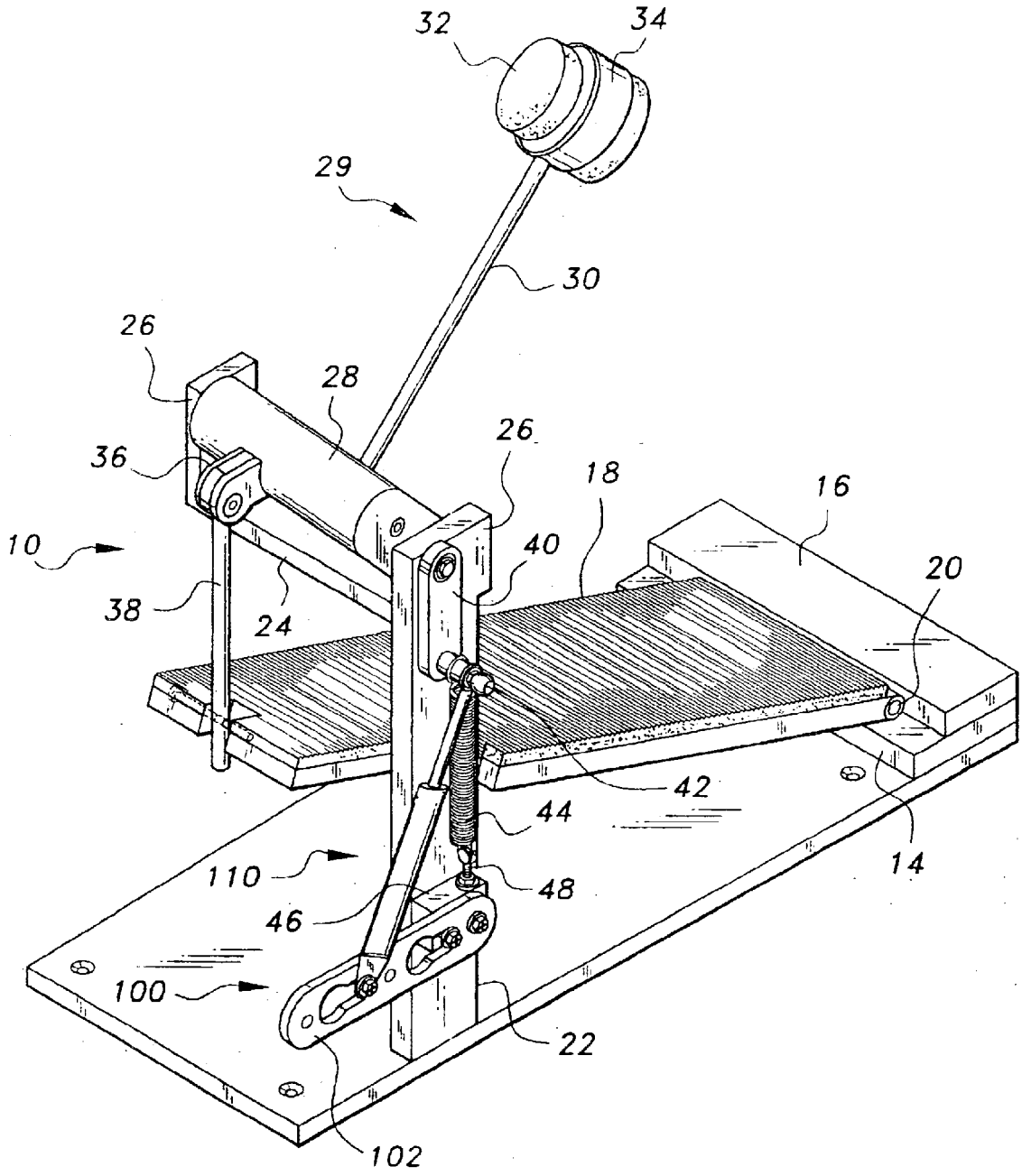
FIG. 2 is a perspective view of a drum pedal incorporating the drum pedal stabilizer according to the present invention.

The stabilizer 100 is shown attached to a representative drum pedal 10 in FIGS. 1 and 2. There are a great variety of drum pedal designs available. Virtually all drum pedals incorporate a return spring. Therefore, the stabilizer is not restricted to use with the particular drum pedal 10 shown in FIGS. 1 and 2, but may be used with any drum pedal incorporating a return spring.

The drum pedal 10 has a base platform 12 having a pedestal 14 with a riser 16 attached to the rear end of the platform 12. A foot plate 18 is pivotally attached to the pedestal 14 by a hinge or pivot pin 20. At lease one upright 22 is attached to the forward end of the platform 12. The upright 22 defines a fork 24. In some drum pedals, the base platform 12 will have a pair of parallel uprights attached to the forward end of the base platform 12 to define the fork. In the drum pedal 10 of FIGS. 1 and 2, the drum pedal 10 has a single upright 22, with the fork 24 extending from the single upright 22 in cantilever fashion. The two branches 26 of the fork are journalled to receive a beater shaft 28 pivotally mounted on the fork 24. The two branches 26 of the fork 24 may have bearings (ball, roller or needle bearings) mounted therein for smoother rotation of the shaft 28.

A beater 29 is attached to the shaft 28. The beater 29 includes a beater support arm 30 extending from the shaft 28 and a hammerhead or mallet 32 mounted at the free end of the beater arm 30 by a loop 34 or other attachment means. A linkage is connected between the toe end of the foot plate 18 and the shaft 28. In the drum pedal 10 shown in FIGS. 1 and 2, the linkage includes a lever arm 36 fixed to the shaft 28 in order to rotate with the shaft 28 and extending from the shaft 28, and a rod 38 having a first end pivotally mounted to the lever arm 36 and a second end pivotally attached to the toe end of the foot plate 18. Thus, when the foot plate is depressed, the beater 29 is pulled forward by the linkage to strike the drum, and when the beater 29 returns to its start position, the linkage pulls the foot plate 18 up to its original position.

It is known to use various linkage systems in drum pedals. In some drum pedals, the linkage may comprise a chain and sprocket mechanism. In other drum pedals the linkage may comprise a flexible cord of leather or nylon cord wound around a pulley system. The present invention will function with any conventional linkage, or may be used in conjunction with the novel linkages described in FIGS. 4 and 5 below.

The drum pedal 10 includes a bias system for returning the beater to its rest position. The bias system includes a lug 40 having a first end fixed to an end of the shaft 28 external to the upright 22 in order to rotate with the shaft 28. A pin or bolt 42 projects outwardly from the second end of the lug 40. A return spring 44 has a first end attached to bolt 42. A spring mounting bracket 46 projects from the lower end of the upright 22. A spring support 48, usually adjustable in height, projects upward from the bracket 46, and the second end of the return spring 44 is attached to the support 48. The return spring 44 is usually a helically wound tension spring. The tension of the return spring 44 is adjusted via the spring support 48 so that the beater 29 is cocked at the desired tension with the lug 40 and the return spring 44 aligned essentially linearly at equilibrium.

When the foot plate 18 is depressed to strike the beater 29 against the drum, the lug 40 rotates with the shaft 28, expanding the return spring 44. When pressure is removed from the foot plate 18, the return spring 44 contracts to return the beater 29 to its rest position. However, due to inertia from the weight of the mallet 32, the beater 29 oscillates and only returns to the rest position when the oscillations die down. Oscillation of the spring 44 may lead to dropout or hammerdown.

The above description essentially describes the structure and operation of a conventional drum pedal.

Figure 3:
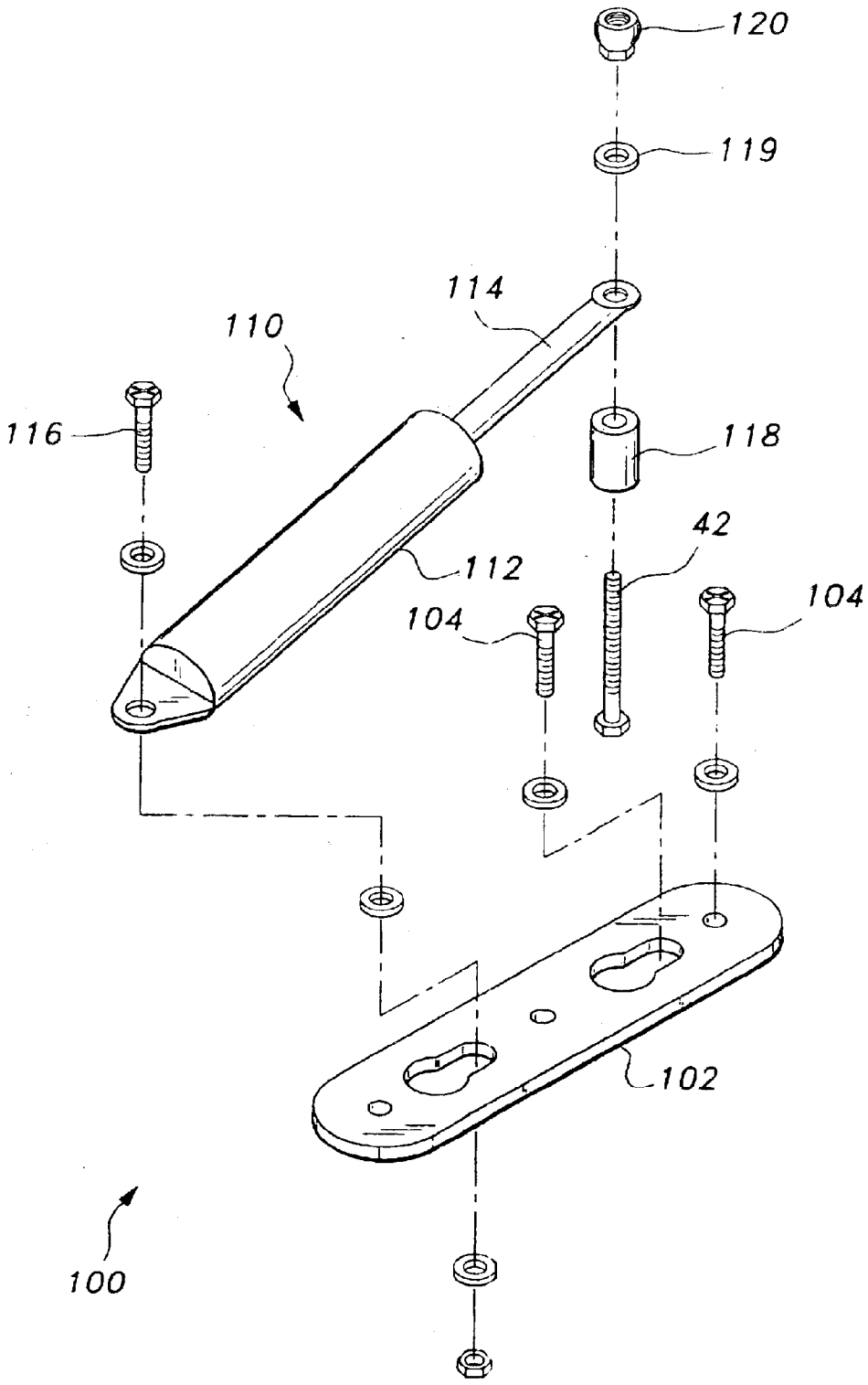
FIG. 3 is an exploded view of a drum pedal stabilizer according to the present invention.

According to the present invention, the drum pedal 10 includes a stabilizer 100 to prevent unwanted oscillation and eliminate dropout. The stabilizer 100 additionally stabilizes the entire drum pedal 10. Referring to FIGS. 1–3, the stabilizer 100 includes a mounting bracket 102 and a gas spring 110. The mounting bracket 102 is an elongated plate attached to the end of the spring mounting bracket 46. The bracket 102 has a plurality of openings defined therein, which may include circular holes and keyhole slots. The stabilizer mounting bracket 102 is attached to the spring support bracket 46 by a pair of screws or bolts 104 used to mount both brackets 46 and 102 to the upright 22. The stabilizer mounting bracket 102 is prevented from pivoting about the upright 22 by using two spaced apart screws or bolts in attaching the stabilizer mounting bracket 102 to the spring mounting bracket 46 and to the upright 22. The stabilizer mounting bracket 102 is elongated, so that its free end is offset from the upright 22, preferably extending normal to the upright 22.

The gas spring 110 includes the usual cylinder 112 and sliding rod 114 extensible from the cylinder 112. A lug extending from the base of the cylinder 112 permits pivotal attachment of the cylinder 112 to the free end of the stabilizer mounting bracket 102 by bolt 116 outboard from the upright 22 in a direction opposite to rotation of the lug 40 when the pedal 10 is depressed, i.e., the lug 40 rotates rearward when the foot plate 18 is depressed while the cylinder 112 is attached forward of the upright 22. The free end of the sliding rod 114 is pivotally attached to bolt 42. In order to ensure smooth action of the gas spring 110, the original drum pedal lug bolt is replaced with elongated bolt 42, and a nylon spacer 118 is placed between the end of the return spring 44 and the free end of the sliding rod 114, which is then secured by a washer 119 and nut 120, or other appropriate hardware.

The gas spring 110 preferably has a pressure of between two and six pounds. Alternatively, the pressure of the gas spring may be adjustable.

In operation, when the foot plate 18 is depressed, the link rod 38 and lever arm 36 rotate the beater 29 forward to strike the drum, simultaneously rotating the lug 40 rearward and extending the return spring 44 and sliding rod 114 of the gas spring 110. When pressure is released from the foot plate 18, the return spring 44 contracts, rotating the lug 40 and shaft 28 clockwise to return the beater 29 to the rest position. Simultaneously the sliding rod 114 retracts into the cylinder 112. When inertia moves the free end of the lug 40 forward of the upright 22, the movement is resisted by gas pressure in the cylinder 112 of the gas spring 110, thereby dampening oscillation. Similarly, when the return spring 44 extends as the mallet 32 rotates forward towards the rest position, the gas spring 110 resists further extension of the sliding rod 114, again dampening oscillation. Consequently, the stabilizer 100 reduces rhythmic flutter and eliminates dropout or hammerdown caused by oscillation of the return spring 44.

It will be understood that although a particular return spring 44 structure has been shown in FIGS. 1 and 2, that the various models of drum pedals available have similar structure so that it is always possible to mount the stabilizer mounting bracket 102 to the upright 22 in such a position that the base of the gas spring 110 can be offset from the linear alignment of the lug 40 and the return spring 44 in the rest position. A bearing may be inserted in the free end of the sliding rod 114 for smoother pivoting, if desired.

Figure 4:
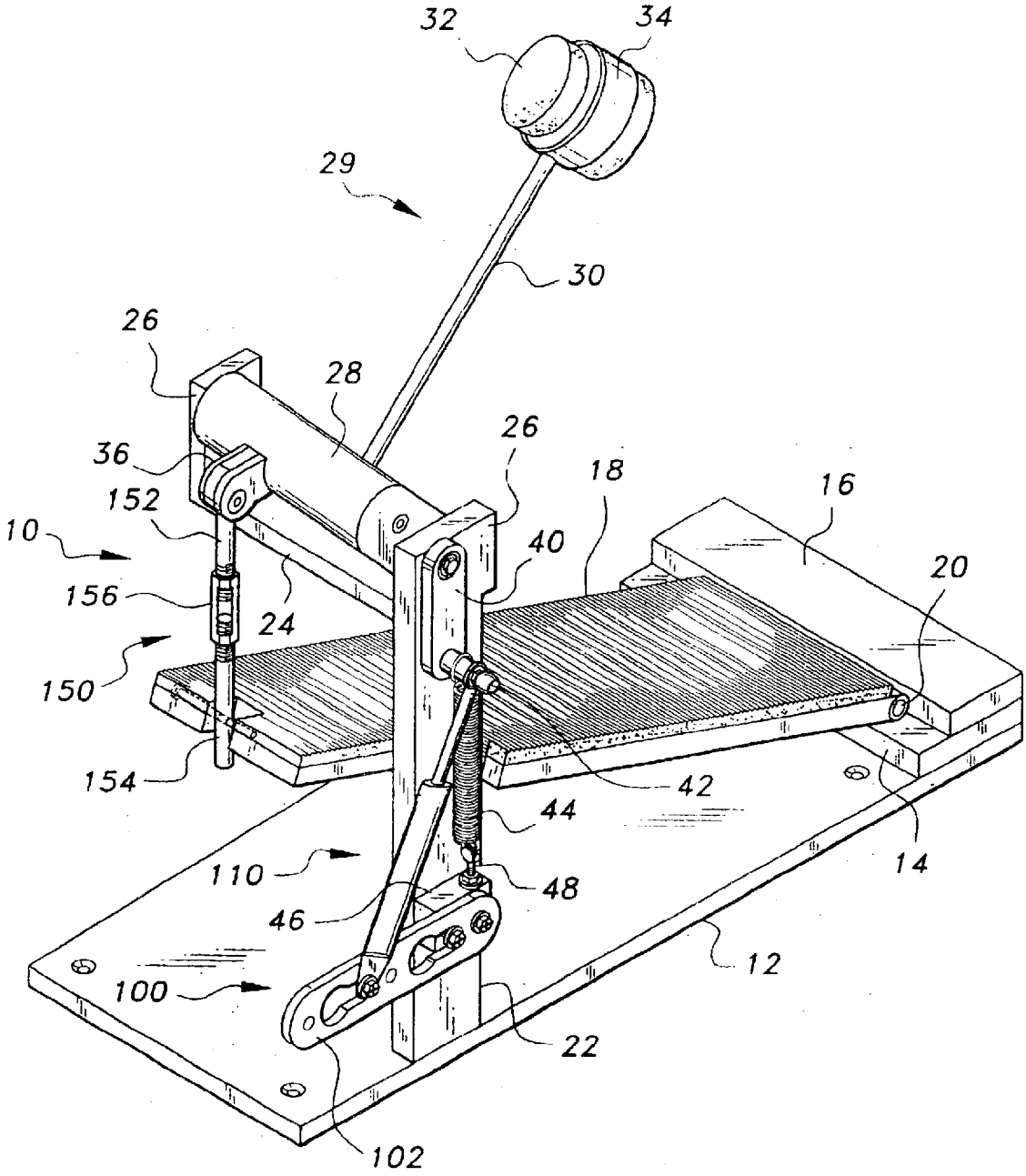
FIG. 4 is a perspective view of a drum pedal incorporating the drum pedal stabilizer and a turnbuckle linkage according to the present invention.
Figure 5:
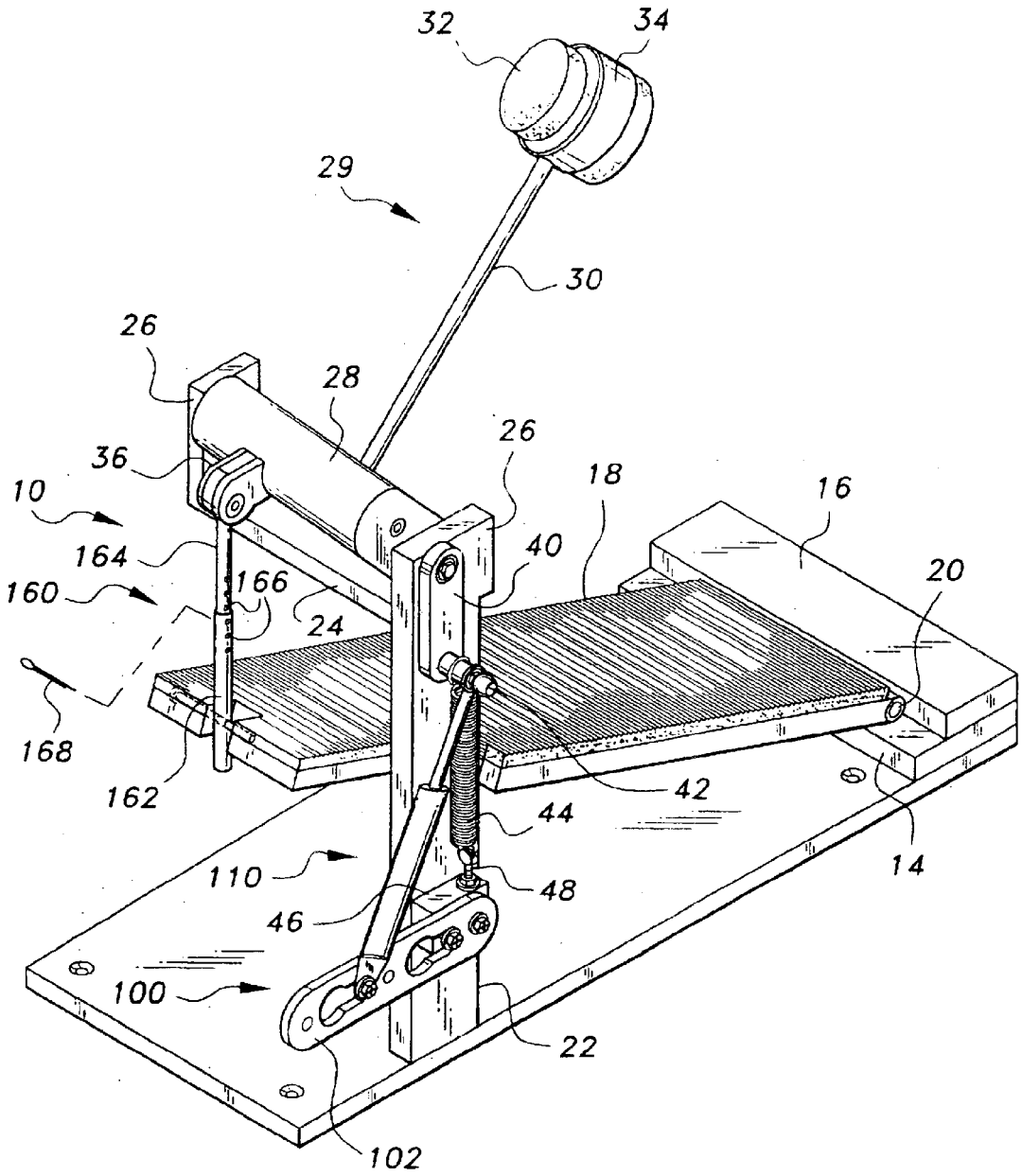
FIG. 5 is a perspective view of a drum pedal incorporating the drum pedal stabilizer and a telescoping rod linkage according to the present invention.

FIGS. 4 and 5 illustrate novel adjustable linkages for adjusting the height of the foot plate 18 and rotating the beater shaft 28. The adjustable linkages may raise, lower or angle the foot plate 18. The adjustable linkages work in cooperation with the gas spring 110 to provide the desired weighted feel and foot pedal speed, given the tension applied by the return spring 44. FIG. 4 shows a turnbuckle linkage 150. The turnbuckle 150 comprises an upper rod 152 pivotally attached to the lever arm 36 fixed to the shaft 28, and a lower rod 154 pivotally attached to the toe end of the foot plate 18. A hollow sleeve or shell 156 connects the upper rod 152 and the lower rod 154. The upper rod 152 and lower rod 154 are both threaded, but in opposite directions, i.e., one rod has right hand threads while the other has left hand threads. The hollow shell 156 has threaded bores in opposite ends, the bores being threaded in opposite directions, so that when the shell 156 is rotated in a clockwise direction, the linkage 150 is shortened to raise the toe end of the foot plate 18, and the linkage 150 is lengthened when the shell 156 is rotated counterclockwise to lower the toe end of the foot plate 18, or vice versa.

FIG. 5 shows an adjustable pin linkage 160. The pin linkage 160 includes a hollow, tubular, lower rod 162 pivotally attached to the toe end of the foot plate 18 and either a solid or hollow, tubular, upper rod 164 pivotally attached to the lever arm 36, which is fixed to the beater shaft 28. Both the lower rod 162 and upper rod 164 have a plurality of apertures 166 spaced apart and extending longitudinally along the rods. Alternatively, one rod 162 or 164 may have a single aperture 166 defined therein, while the other rod 164 has a plurality of spaced apart apertures 166 defined therein. As shown in FIG. 5, the upper rod 164 has a smaller outer diameter than the inner diameter of the lower rod 162 so that the upper rod 164 telescopes into the lower rod 162. A pin 168, such as a cotter pin, hitch pin, or other suitable fastener, is inserted through aligned apertures 166 in the upper 164 and lower 162 rods to fix the length of the linkage 160. Thus, the height of the linkage 160 may be adjusted by raising or lowering the toe end of the foot plate 18 to slide the upper rod 164 into or out of the lower rod 162 until the desired pair of apertures 166 is aligned, and then inserting the pin 168 through the aligned apertures 166 to adjust the height of the linkage 160.

It is to be understood that the present invention is not limited to the embodiments described above, but encompasses any and all embodiments within the scope of the following claims.

I claim:

1. A drum pedal stabilizer for attachment to a drum pedal having a return spring with a first end attached to an upright and a second end attached to a free end of a lug keyed to a pivotally mounted beater shaft, the return spring and lug being linearly aligned in a rest position, the stabilizer comprising:

(a) an elongate stabilizer mounting bracket having a first end adapted for attachment to the upright adjacent the first end of the return spring and having a second end adapted for extending normal to the upright; and (b) a gas spring having a cylinder and a rod slidably extensible from the cylinder, the cylinder being pivotally attached to the second end of the stabilizer mounting bracket and the rod being adapted for pivotal attachment to the second end of the lug;

whereby the gas spring dampens oscillation of the return spring when the return spring returns to the rest position; and whereby the drum pedal stabilizer provides a weighted feel when a user depresses a drum pedal foot plate.

2. The drum pedal stabilizer according to claim 1, further comprising linkage means extending between the beater shaft and a toe end of the drum pedal foot plate for rotating the beater shaft when the foot plate is depressed.

3. The drum pedal stabilizer according to claim 2, wherein said linkage means comprises a turnbuckle having a first end connected to the toe end of the foot plate and a second end connected to the beater shaft, whereby said linkage means adjusts raising, lowering and angling the toe end of the foot plate.

4. The drum pedal stabilizer according to claim 2, wherein said linkage means comprises:

(a) a first tubular rod pivotally connected to the toe end of the foot plate and having at least one pair of aligned holes extending transversely therethrough;

(b) a second tubular rod pivotally attached to the beater shaft and having a plurality of pairs of aligned holes extending transversely therethrough and spaced apart along the rod, the second tubular rod being slidable in the first tubular rod; and (c) a pin inserted through aligned holes in the first and second tubular rods;

whereby said linkage means adjusts raising, lowering and angling the toe end of the foot plate.

5. The drum pedal stabilizer according to claim 1, further comprising a bearing inserted into a free end of the sliding rod of said gas spring for smoother pivoting.

6. The drum pedal stabilizer according to claim 1, wherein said gas spring has adjustable pressure.

7. A drum pedal with a drum pedal stabilizer, comprising:

(a) a base platform having a front end and a rear end;

(b) a foot plate having a toe end and having a heel end pivotally attached to the rear end of the base platform;

(c) at least one upright defining a fork extending above the front end of the base platform;

(d) a beater shaft journalled into the fork, the shaft having a beater affixed thereto;

(e) linkage means extending between the beater shaft and the toe end of the foot plate for rotating the beater shaft when the foot plate is depressed;

(f) a lug keyed to an end of the beater shaft in order to rotate therewith, the lug having a free end;

(g) spring mounting bracket extending from the upright;

(h) a return spring having a first end attached to the spring mounting bracket and a second end attached to the free end of the lug, the spring and the lug being linearly aligned when in a rest position;

(i) an elongate stabilizer mounting bracket having a first end attached to the upright adjacent the first and of the return spring and having a second end extending normal to the upright; and (j) a gas spring having a cylinder and a rod slidably extensible from the cylinder, the cylinder being pivotally attached to the second end of the stabilizer mounting bracket and the rod being pivotally attached to the second end of the lug;

whereby the gas spring dampens oscillation of the return spring when the return spring returns to the rest position; and whereby the drum pedal stabilizer provides a weighted feel when a user depresses a drum pedal foot plate.

8. The drum pedal with a drum pedal stabilizer according to claim 7, wherein said linkage means comprises a turnbuckle having a first end connected to the toe end of said foot plate and a second end connected to said beater shaft, whereby said linkage means adjusts raising, lowering and angling the toe end of the foot plate.

9. The drum pedal with a drum pedal stabilizer according to claim 7, wherein said linkage means comprises:

a first tubular rod pivotally connected to the toe end of said foot plate and having at least one pair of aligned holes extending transversely therethrough;

a second tubular rod pivotally attached to said beater shaft and having a plurality of pairs of aligned holes extending transversely therethrough and spaced apart along the rod, the second tubular rod being slidable in the first tubular rod; and a pin inserted through aligned holes in the first and second tubular rods;

whereby said linkage means adjusts raising, lowering and angling the toe end of the foot plate.

10. The drum pedal with a drum pedal stabilizer according to claim 7, further comprising a bearing inserted into a free end of the sliding rod for smoother pivoting.

11. The drum pedal with a drum pedal stabilizer according to claim 7, wherein said gas spring has adjustable pressure.

* * * * *

UNITED STATES PATENT AND TRADEMARK OFFICE

CERTIFICATE OF CORRECTION

PATENT NO. : 6,924,422 B2
DATED : August 2, 2005
INVENTOR(S) : Johnathan R. Wise It is certified that error appears in the above-identified patent and that said Letters Patent is hereby corrected as shown below:

Title page,
Item [76], Inventor, should be corrected to -- Johnathan R. Wise --.

Signed and Sealed this

Fourth Day of October , 2005

JON W. DUDAS
*Director of the United States Patent and Trademark Office*